United States Patent [19]

Guedet

[11] 4,224,779

[45] Sep. 30, 1980

[54] METHOD FOR FABRICATION OF COATED METAL PACKAGES BY THERMOFORMING

[75] Inventor: Robert Guedet, Le Chesnay, France

[73] Assignee: SCAL Societe de Conditionnements en Aluminium, Paris, France

[21] Appl. No.: 945,060

[22] Filed: Sep. 22, 1978

[30] Foreign Application Priority Data

Sep. 23, 1977 [FR] France ..... 77 29408

[51] Int. Cl.[3] ..... B65B 55/06; B65B 47/02

[52] U.S. Cl. ..... 53/426; 53/453; 427/25

[58] Field of Search ..... 53/453, 426, 559; 427/26, 25

[56] References Cited

U.S. PATENT DOCUMENTS

| | | | |
|---|---|---|---|
| 2,712,717 | 7/1955 | Keller | 53/453 |
| 3,430,411 | 3/1969 | Ollier et al. | 53/453 |
| 3,486,484 | 12/1969 | Bullough | 427/26 |
| 3,865,610 | 2/1975 | Goodridge et al. | 427/25 X |
| 3,911,640 | 10/1975 | Rausing | 53/453 X |

*Primary Examiner*—Travis S. McGehee

*Attorney, Agent, or Firm*—Dennison, Dennison, Meserole & Pollack

[57] ABSTRACT

A method for continuous packaging in metal packages produced in situ, the invention comprises the fabrication of aluminum containers from aluminum sheet immediately prior to packaging of a material in the containers, the operations being conducted as part of a continuous flow process. The metal packages are produced by thermoforming, that is, the deformation of a heated metal body in a mold by pressure, thereby resulting in the production of containers which are aseptic and which can be easily coated with a protective layer of a plastic or similar material. The invention is particularly useful for the packaging of perishable produce.

8 Claims, 2 Drawing Figures

METHOD FOR FABRICATION OF COATED METAL PACKAGES BY THERMOFORMING

BACKGROUND OF THE INVENTION

1. Field of the Invention

The invention generally relates to a process for forming metal packages in a continuous package formation/-filling operation and particularly to a process for forming such a metal package in situ with a coating thereon, particularly a coating formed of an organic plastic material.

2. Description of the Prior Art

According to the present practices in the mass production of packaging, pharmaceuticals, foodstuffs and other products are packaged in integrated packaging processes which operate at a high production rate, the individual packages being produced in situ continuously from sheets of plastics material. The packages are thus produced in an economical manner immediately before filling of the packages, thereby avoiding wasteful handling and storage. In prior packaging processes of this type, organic plastic materials have been fabricated by thermoforming techniques. Products which are particularly sensitive to oxidation or to light, however, cannot be packaged adequately through the use of plastic, metal packaging being required to ensure proper sealing. It has not been possible previously to utilize the in situ thermoforming packaging processes referred to above in situations where metal packaging was required since it has not been possible to fabricate packages of metal, even of aluminum, through use of a thermoforming process. Metal packaging has therefore typically been formed by operation separate from the package filling operation.

A thermoforming process comprises the heating of a thin-walled blank, in most cases a cup-shaped member or a simple flat sheet, to an elevated temperature which is lower than the melting temperature of the material which is to be molded but which is sufficient to soften that material to a "plastic" state. The desired shape is then imparted to the blank by applying the blank against the surface of a mold by the action of a fluid under pressure. At the present time, thermoforming has been used to mold various metals such as alloys based on magnesium, aluminum, copper, titanium, stainless steel and nickel. Aluminum alloys known as superplastic alloys have been developed which are particularly suited to use in thermoforming processes. However, thermoforming can only be used with metals to produce slow rates of deformation of the metal, French Pat. No. 2,004,410, for example, indicating that the removal of thin-walled members in a hot condition from a mold gives rise to serious difficulties. The operation of removing formed metal members from a mold may be facilitated by coating the molds with a foundry wash (clay and resin) or by coating the surface of the blank with a graphite oil. Such techniques require cleaning after package formation, particularly when foodstuffs are to be packaged. These supplementary operations increase costs and reduce the speed of production.

For the reasons described, thermoforming of metal has been restricted hitherto to small-scale production of complicated members such as those for the aviation industry or for data processing equipment. Prior to the present invention, the production of metal containers by thermoforming at industrial rates of production and integration of such a production process into a continuous packaging train has been considered impossible. Thus, at the present time, metal containers are produced in a cold condition by processes such as stamping or rolling of a sleeve-like member followed by welding and crimping of the members. The metal surfaces of such packages then must be cleaned and pickled before coated with varnish or lacquer. Such a mode of manufacture involves operations both of a chemical and of a mechanical nature, the operations being carried out at varying rates thereby rendering it virtually impossible to integrate all or even most of the operation into a continuous process for packaging consumable products. The metal containers are at present produced in specialist factories from which they must be dispatched to the packaging location, thereby giving rise to the necessity for costly intermediate storage. All these handling operations, interruptions in loading feed, and storage, increase the cost of the metal containers which, due to the cost of the material itself, is already higher than the cost of containers made of standard plastic material. Finally, if such containers are to be used for aseptic filling, they must be sterilized before filling.

SUMMARY OF THE INVENTION

Contrary to accepted notions, it has now been found that packages comprised to aluminum alloys can be thermoformed at high production rates of the order of from 1000 to 2000 members per hour, provided that the thermoforming operation is restricted to maximum values of elongation of the order of 100% and to ratios between the surface area $S_1$ of the thermoformed member and the surface area of the blank $S_0$, of the order of:

$$S_1/S_0=1.4$$

According to the particular teachings of the invention, aluminum alloys of current qualities can be fabricated by thermoforming and can therefore be incorporated into a continuous package fabrication/filling process. Further, production by thermoforming in accordance with the invention produces containers which are naturally heat-sterilized on direct delivery to the filling station without the danger of contamination in the course of handling operations. Packages so produced are particularly well suited for aseptic filling.

The surface container produced by the present process is particularly suitable for receiving a coating of a plastic material with an excellent degree of adhesion and without any particular treatment, such as coating of the surface with an adhesive. In most cases, the plastic material coating operation is preferably performed at a temperature higher than 120° C., such a process thus directly producing coated and aseptic containers suitable for being filled aseptically without requiring any specific sterilization treatment. It is sufficient for the containers to be kept under sterile conditions until the filling operation.

For simplicity of expression, it is to be understood that the aluminum alloys referred to hereinafter will be stated by the use of the term "aluminum". Further, it is also to be appreciated that the "plastic" materials which are typically organic in nature may be referred to as being in a "plastic", that is, semi-solid or fluid, state when applied to the thermoformed metal containers formed according to the invention. The "plastic" material which is applied to the metal containers may be any material, organic "plastic" or otherwise, which is advantageously applied to the metal containers when said containers are in a heated state such that adhesion of the material to the metal surfaces is enhanced. In a less general sense, the invention is particularly useful for forming metal packages having a coating of "organic plastic" material formed thereon in a continuous flow in situ package forming/filling process. Thus, the present invention provides a process for providing an integrated continuous packaging process in which containers formed particularly of aluminum are produced in situ by continuous thermoforming from thin-wall aluminum blanks. The blanks are generally simple roll-fed sheets or are in the form of portions which have been previously cut to size. The process provides containers which are aseptic, due to having been produced in a suitable thermal environment without the necessity for the containers to be subsequently sterilized. The process makes it possible to effect aseptic filling of the containers on the sole condition that the containers are protected from any pollution between the thermoforming mold and the filling station. By adding a simple installation for coating the containers with a plastic material, the process even makes it possible to produce in situ coated aseptic containers, as the coating operation is easily integrated into the packaging process.

The substantial advance provided by the invention is largely due to the use of aluminum blanks covered with a regular artificial layer of alumina, the alumina layer greatly facilitating the operation of removing the thermoformed members from the mold and eliminating the need to coat the surfaces of the mold or of the blanks before thermoforming with any substance whatever. The present invention essentially comprises the following steps:

(1) feeding metal blanks, in most cases in the form of a sheet in a roll or of thin metal sheet in portions which have been pre-cut to the required sizes, to a thermoforming apparatus, the thin-wall blanks being preferably formed of aluminum which has previously been covered with a layer of artifical alumina;

(2) pre-heating the blanks and then thermoforming the blanks in molds of suitable shape, the thermoforming temperature being generally from 0.7 to 0.9 Tf, Tf being the absolute melting temperature of the metal;

(3) optionally coating the formed packages with a plastic material after removal of the formed packages from the mold and while the packages are heated, the container not being allowed to cool excessively upon issuing from the thermoforming mold; and, (4) closing the packages after filling, such as with a cover formed of a metal of the same nature as the package itself, the packages being closed by heatsealing.

It will be noted that the present process of thermoforming packages or containers is economically attractive when using thin metal sheets which are from 0.10 to 0.20 mm in thickness. The mass and consequently the thermal inertia of such containers is very low, such containers cooling almost instantly upon leaving the mold. If it is desired that the containers should then be coated with a plastic covering, such as by projection particles onto the hot surface of the containers, it will be necessary to ensure that the containers are maintained at the correct temperature without placing excessive reliance on their actual temperature when they leave the mold. The operation of coating the containers with a plastic material may be effected in the form of electrostatic projection of fine filamentous particles which reach the surface to be covered in a substantially pasty condition. Such particles possibly become re-liquified on the hot surface and then rapidly solidify when the container generally cools down. In order to provide a coating which has a sufficient sealing action with respect to aggressive substances such as tomato sauce or sauerkraut, the thickness of the coating must be greater than 10μ. Depending on the type of plastic material used and the degree of sealing required, the thickness of the coating will normally be from 10μ to 200μ. Various plastics may be used of the organic type, such as polyester, polypropylene or polyethylene.

It should be noted that, in order to facilitate removal of the thermoformed container from the mold, the layer of alumina on the surface of the aluminum sheet must be regular in thickness and must be more than 0.01μ and preferably from 0.04μ to 0.50μ in thickness. Thicker alumina layers, namely 1μ and more in thickness, do not give rise to trouble but are more expensive. The alumina layer may be formed by anodic oxidation or chemically and may then be in the form of boehmite. The oxidation installation may itself be incorporated into the packaging process. However, adding a chemical or electrochemical treatment operation into an already complex packaging train will not always be a desirable matter.

It is known that a layer of alumina forms an excellent keying means for the plastic material coatings.

It is therefore a primary object of the invention to provide a packaging process which eliminates the transportation of empty packages, intermediate treatments of greasing, cleaning, pickling and sterilizing metal sheets and containers, and which greatly facilitates packaging and reduces the cost thereof. The invention further facilitates aseptic filling operations at very low cost.

Further objects and advantages of the invention will become more readily apparent in light of the following detailed description of the preferred embodiments.

DESCRIPTION OF THE PREFERRED EMBODIMENTS

Figure 1:
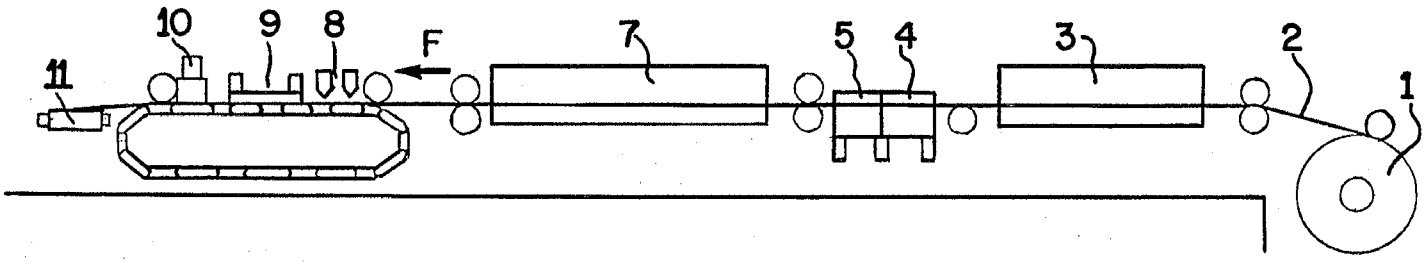
FIG. 1 is a diagrammatical elevational view of an integrated packaging process which includes the production and filling of trough-like containers formed directly from a sheet of aluminum; and, FIG. 2 is a diagrammatical elevational view of an apparatus for coating containers with a plastic material by an electrostatic process.

Referring to FIG. 1, a sheet 2 of aluminum, such as alloy, is displaced in the direction indicated by arrow F in a discontinuous forward feed movement from a roll 1. The sheet 2 of aluminum is preferably 0.14 mm in thickness and is first subjected to anodic oxidation in an aqueous solution of sulfuric acid in accordance with a known process, this operation being performed in the installation indicated diagrammatically at 3. This treatment produces a porous surface layer of alumina which is 0.50μ in thickness. The sheet 2 then passes into a thermoforming installation formed by a pre-heating furnace 4 and a heated mold 5 which is made of steel. The sheet 2 is pre-heated in the furnace 4 and then passes into the mold 5 which is heated to a temperature of approximately 580° C. The temperature of the sheet 2 itself hardly exceeds 470° C. Under the affect of a pressure of 0.07 MPa which is progressively applied to the upper part of the sheet 2, trough-like containers 6 are formed in groups of four at a time, at a rate of 10 groups per minute. These containers typically have a mouth opening which measures 150×135 mm, and are 35 mm in depth. In spite of a temperature of more than 400° C., the formed containers 6 would rapidly cool upon leaving the mold due to their small mass if they were not re-heated. The containers pass directly into an installation 7 in which they are maintained at a temperature of the order of 180° C. and are coated with a protective layer of polypropylene or other plastic material as aforesaid by means of the process in greater detail hereinafter.

Because of the layer of alumina, adhesion of the plastic material to the containers is excellent. By virtue of the hot coating operation, the containers are in an aseptic condition. Provided that the containers are kept in an aseptic enclosure, they may be immediately filled with pharmaceutical or foodstuff products, without any cleaning or sterilization treatment. This is performed in a station for filling the containers at 8 and heat-sealing the containers at 9. The containers 6, now filled and heat-sealed, are cut off at 10 and then discharged directly by a conveyor 11 to a dispatch station.

Figure 2:
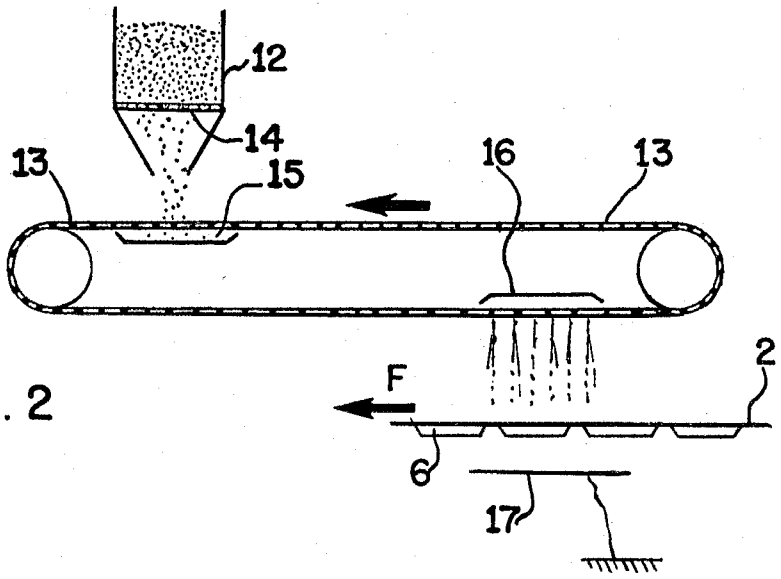

The operation of coating the containers 6 with a fine continuous layer of polypropylene, which is 50μ in thickness, is performed in the installation 7 by means of the process shown in FIG. 2. The polypropylene, which is cold and in a powdered state, is stored in a hopper 12 of insulating material. From the hopper 12, the polypropylene falls onto an endless chain of bars 13 which are almost touching each other. Fixed bars 14 disposed in the hopper 12 form a set of electrodes and electrically charge the polypropylene particles which pass therethrough. The bars 13 of the endless chain are raised to an electrical potential of opposite sign and accordingly attract the particles which pass close thereto, the particles thus adhering to the bar surface. The particles are entrained by the bars in the direction indicated by arrow f. If particles escape the attraction force applied by the bars 13, they are recovered by the moving belt 15. The bars 13 bearing their loads of polypropylene powder pass in front of a heating installation 16 at which the polypropylene is liquified, while continuing to adhere to the bars 13. The containers 6 which are at a temperature of 180° C. and which are integral with the sheet 2 pass in front of the bars 13, being displaced in the direction indicated by arrow F. An electrode 17 generates an electrical field directed from the bars 13 towards the container 6. The power consumption is of the order of 5 A at a voltage of 5 V. The hot polypropylene flows in the direction of the electrical field in the form of fine liquid filaments which are 10 microns in diameter and 50 microns in length approximately. The plates 6 are maintained at a temperature of 180° C. by a suitable heating means. The filaments are in a substantially pasty condition when they come into contact with the hot metal surface. They do not form a fibrous layer of felted texture. On the contrary, the plastic material is distributed over the hot surface in a very uniform manner in the form of a continuous layer which is about 50μ in thickness and which solidifies quickly as soon as the containers 6 leave the heated region. It will be seen that this process thus produces coated, aseptic containers directly form a metal sheet and from finely divided plastic material, without any cleaning and sterilization operation. It is also possible to use other more conventional coating methods, for example, projecting fine particles of liquid plastic material, which are electrically charged and projected by an air jet, onto the containers which are kept in a hot condition. The particles may also be produced by a process of the spinning type.

As indicated hereinbefore, the filling operation is performed immediately at the station 8, filling the thin containers 6 which cool very quickly because of their small mass. The heat-sealing operation which is performed on the upper face of the polypropylene-coated containers is easily effected at the station 9. If appropriate, it is even possible to add a final treatment for the containers and the contents thereof, between the stations 9 and 10. An integrated continuous package fabrication/filling process is therefore provided, the packages formed in situ being filled with consumable product followed by closing of the containers and possibly final treatment of the production so produced without any interruption in feed. This process avoids any treatment for cleaning the containers 6 before they are coated with a plastic material and any operation of cleaning and sterilizing the coated containers before they are filled. Adhesion of the polypropylene layer to the containers is greatly promoted by the relatively thick layer of alumina on the surface of the containers. The covers are themselves coated with polypropylene by a process which is similar to that shown in FIG. 2. The operation of heat-sealing the coated covers, in an aseptic manner, is extremely easy as the polypropylene of the container 6 is welded to the polypropylene of the cover.

It will be seen that the containers are handled from one station to another in a very simple manner by means of the sheet 2 from which the containers 6 are detached only at the end of the production train or the cutting station 10. It will be appreciated that, for products which do not have a corrosive action, such as cakes or dairy products, the plastic material coating 7 does not serve any purpose, and the containers 6 are filled immediately after the thermoforming operation at 5. In the example described, anodic oxidation of the sheet 2 is performed in the packaging installation itself, but in many cases it will be advantageous to use sheets 2 which have been previously oxidized by the aluminum supplier. In the same installation, it is possible to use sheets of aluminum of various compositions. The thermoforming temperature in the mold 5 must be controlled in consequence of such variations. Thus, for an aluminum of quality or alloy 2002, the thermoforming temperature is 520° C. and the temperature of the mold 5 will be controlled to approximately 620° C. Alloy designations are in conformance with French standard A02 104.

It is to be understood that the invention can be practiced in a variety of modes which follow from the teachings of the invention, the invention not being limited to the particular embodiments described but rather being defined by the scope of the appended claims.

I claim:

1. A process for the continuous packaging under sterile conditions of a consumable product in metal containers, comprising the steps of:

continuously thermoforming containers from metal blanks formed of aluminum having a thickness of from 0.10 to 0.50 mm, the blanks being covered with a layer of artifical alumina, the thermoforming temperature being sufficient to sterilize the containers thus formed;

maintaining the sterile thermoformed containers thus formed under sterile conditions subsequent to thermoforming and at least prior to and during subsequent continuous flow process operations; and filling the sterile containers with the consumable product in a continuous flow process which includes sterile formation of the containers by thermoforming, the containers being maintained under sterile conditions during filling to assure packaging under aseptic conditions.

2. The process of claim 1 wherein thermoforming of the containers is performed at a temperature of from 0.7 Tf to 0.9 Tf, Tf being the absolute melting temperature of the constituent metal of the containers.

3. The process of claim 1 wherein the layer of alumina is of a regular thickness of from 0.01 micron to 1 micron.

4. The packaging process of claim 3 wherein the layer of alumina is of a regular thickness of from 0.04 micron to 0.50 micron.

5. The process of claim 1 and further comprising the step of coating the containers with a plastic material at a temperature of more than 120° C. prior to filling of the containers.

6. The process of claim 5 and further comprising the step of maintaining the coated containers under sterile conditions until the containers are filled.

7. The process of claim 5 wherein the coating is effected by projecting fine particles of the plastic material onto the surfaces of the metal containers substantially at the melting temperature of the plastic material.

8. The process of claim 5 wherein, during the period of coating of the containers with the plastic material, the containers are maintained at a temperature which is at least equal to the melting temperature of the plastic material.

* * * * *